US006655568B2

(12) United States Patent
Thieleke

(10) Patent No.: US 6,655,568 B2
(45) Date of Patent: Dec. 2, 2003

(54) SETTING TOOL

(75) Inventor: Joachim Thieleke, Wasserburg (DE)

(73) Assignee: Hilti Aktiengesellschaft, Schaan (LI)

( * ) Notice: Subject to any disclaimer, the term of this patent is extended or adjusted under 35 U.S.C. 154(b) by 3 days.

(21) Appl. No.: 09/962,658

(22) Filed: Sep. 25, 2001

(65) Prior Publication Data

US 2002/0038812 A1 Apr. 4, 2002

(30) Foreign Application Priority Data

Sep. 29, 2000 (DE) ..... 100 48 311

(51) Int. Cl.[7] ..... B27F 7/02; B25C 7/00

(52) U.S. Cl. ..... 227/8; 227/10; 227/11; 227/147; 173/4; 173/10; 173/13

(58) Field of Search ..... 173/8, 4, 10, 13, 173/211, DIG. 2; 227/9, 10, 11, 147, 8

(56) References Cited

U.S. PATENT DOCUMENTS

| | | | | | |
|---|---|---|---|---|---|
| 2,666,201 | A | * | 1/1954 | Orden | 227/147 |
| 4,519,536 | A | * | 5/1985 | Steigauf | 227/147 |
| 5,450,911 | A | * | 9/1995 | Gustafsson | 173/13 |
| 6,092,710 | A | * | 7/2000 | Kersten | 227/10 |
| 6,123,243 | A | * | 9/2000 | Pfister et al. | 227/10 |

* cited by examiner

*Primary Examiner*—Stephen F. Gerrity
*Assistant Examiner*—Gloria R Weeks
(74) *Attorney, Agent, or Firm*—Sidley Austin Brown & Wood, LLP

(57) ABSTRACT

A setting tool including a bolt guide (2) secured in the tool housing (1) against displacement in an axial direction, a spring-biased press-on feeler (6) and an axially displaceable safety sleeve (9) surrounding the press-on feeler (6) and supported for joint axial displacement with the press-on feeler and for axial displacement relative thereto.

7 Claims, 3 Drawing Sheets

SETTING TOOL

BACKGROUND OF THE INVENTION

1. Field of the Invention

The present invention relates to a setting tool having a housing, a bolt guide axially secured in the housing, and a press-on feeler displaceable in a direction opposite a setting direction against a biasing force of a spring.

2. Description of the Prior Art

It is conventional to provide in setting tools, which operate with high-pressure gases, press-on safety means that includes a press-on feeler that in the initial position of a setting tool, projects beyond the bolt guide of the setting tool in the setting direction. The press-on feeler is connected with a setting tool device that provides for feeding to the drive piston of the setting tool of high-pressure gases which are generated by a solid, liquid, gaseous, or powder propellant charge. This device is actuated when the setting tool is pressed against a constructional component, and the press-on feeler is displace into its press-on position. A setting tool of this type is disclosed, e.g., in German Publication DE 198 04 456.

The drawback of this setting tool consists in that the press-on feeler, which is formed as a sidewise accessible sleeve, can be displaced into its press-on position as a result of an unconscious hand manipulation, causing actuation of the high-pressure gas feeding device, without the setting tool being pressed against a constructional component.

Accordingly, an object of the present invention is to provide a setting tool of the type described above but with which the displacement of the press-on feeler into its press-on position as a result of an unconscious hand manipulation is not possible.

SUMMARY OF THE INVENTION

This and other objects of the present invention, which will become apparent hereinafter, are achieved by providing a setting tool having an axially displaceable safety sleeve that surrounds the press-on feeler and has an entraining surface facing in a direction opposite the setting direction and cooperating with a facing in the setting direction, counter-surface of the press-on feeler in a position of the safety sleeve in which its facing in a direction opposite the setting direction, free end surface engages the stop surface of the bolt guide, with a first distance between a setting direction-side, end surface of the press-on feeler and the counter-surface of the press-on feeler being greater than a second distance between a setting direction-side, end surface and the entraining surface of the safety sleeve, and with a sixth distance between the free-end surface of the safety sleeve and a setting direction side, end surface of the safety sleeve corresponding at most to a fifth distance between the end surface of the bolt guide and the stop surface of the bolt guide.

According to the present invention, the press-on feeler is formed as a sleeve arranged coaxially with the bolt guide. Manual displacement of the press-on sleeve into its press-on position in which the device for feeding propellant gases is actuated, is practically impossible as the press-on sleeve is surrounded by the safety sleeve. The safety sleeve, however, can be displaced in a direction opposite the setting direction manually until it abuts a stop surface provided on the bolt guide. Upon its displacement, the safety sleeve entrains the press-on sleeve. However in order to insure that the press-on sleeve is not completely displaced into its press-on position by the safety sleeve, in which the feeding of the propellant gases is initiated, the entertaining surface of the safety sleeve, which faces in the direction opposite the setting direction, is axially spaced from the counter-surface of the press-on sleeve in the initial position of the setting tool. Therefore, the press-on feeler is entrained only after the safety sleeve has been displaced a certain amount. The press-on feeler does not reach its press-on position when the safety sleeve abuts the stop surface of the bolt guide, and projects, in the setting direction, beyond the safety sleeve. However, the projected portion of the press-on feeler is not large enough to be grasped by a hand and be displaced in the direction of the press-on position of the press-on feeler. This excludes an unconscious actuation of a setting tool.

Only upon initiation of the press-on process, when the setting direction-side end region of the setting tool, the press-on feeler, the safety sleeve, and the bolt guide are pressed against a surface of a constructional component, the press-on feeler is displaced in its press-on position in which the propellant gases feeding device is actuated. In its press-on position, the press-on feeler is again completely surrounded by the safety sleeve.

In order to be able to keep the amount, by which the press-on feeler projects beyond the setting direction-side end surface of the safety sleeve after the safety sleeve has been manually displaced backward, very small, advantageously, a third distance between the setting direction-side, end surface of the safety sleeve and a facing in the setting direction, bearing surface of the safety sleeve is so selected that it corresponds at most to a fourth distance between the setting direction-side, end surface of the press-on feeler and a facing in a direction opposite the setting direction, support surface of the press-on feeler.

The entraining surface of the safety sleeve, which entrains the press-on feeler upon the manual displacement of the safety sleeve backward, in the direction opposite the setting direction, is advantageously formed by a flange-shaped, first projection provided on the outer profile of the safety sleeve.

In order to insure that a setting tool according to the present invention can be used in locations which are difficult to access, the diameters of the bolt guide, the press-on feeler, and the safety sleeve are so selected that radial distances therebetween in the setting direction end region of the setting tool are kept as small as possible. In order to insure the displacement of the press-on feeler relative to the bolt guide, despite a radial shoulder provided on the bolt guide, the tubular press-on feeler has two, following each other sections having different diameters. The second section of the press-on feeler, which adjoins the first section at its side facing in the direction opposite the setting direction, has an inner diameter that is greater than the diameter of the radial shoulder provided on the bolt guide. The transition region between the two sections is formed as a step with two circular surfaces, of which the surface that faces in the setting direction, forms a counter-surface that cooperates with the entraining surface of the safety sleeve.

The second circular surface of the transition region-forming step, which is located within the press-on feeler, preferably forms a support surface for a spring arranged in the tool housing for displacing the press-on feeler in its initial position after completion of each setting process and lifting of the setting tool off the constructional component.

In order to insure that in the initial position of the setting tool the end surfaces of the press-on feeler and the safety sleeve lie substantially in the same plane, the safety sleeve has preferably a bearing surface which is formed by a flange-shaped second projection provided on the outer profile of the safety sleeve and spaced form the first projection in the direction opposite the setting direction.

This bearing surface abuts, in the initial position of the setting tool, the facing in the direction opposite the setting direction, support surface of the press-on feeler.

The distance between the formed by the first projection of the safety sleeve, entraining surface and the formed by the second projection, bearing surface corresponds to a length equal to the difference between the first and second distances plus the wall thickness of the press-on feeler in the step-shaped transition region.

In order to insure that the amount by which the press-on feeler projects beyond the setting direction-side end surface of the safety sleeve after the safety sleeve has been manually displaced backward, is very small, advantageously, a length distance between the first and second distances and between the third and fourth distances corresponds to 0.1–0.5 of an outer diameter of the safety sleeve without the first and second projections.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
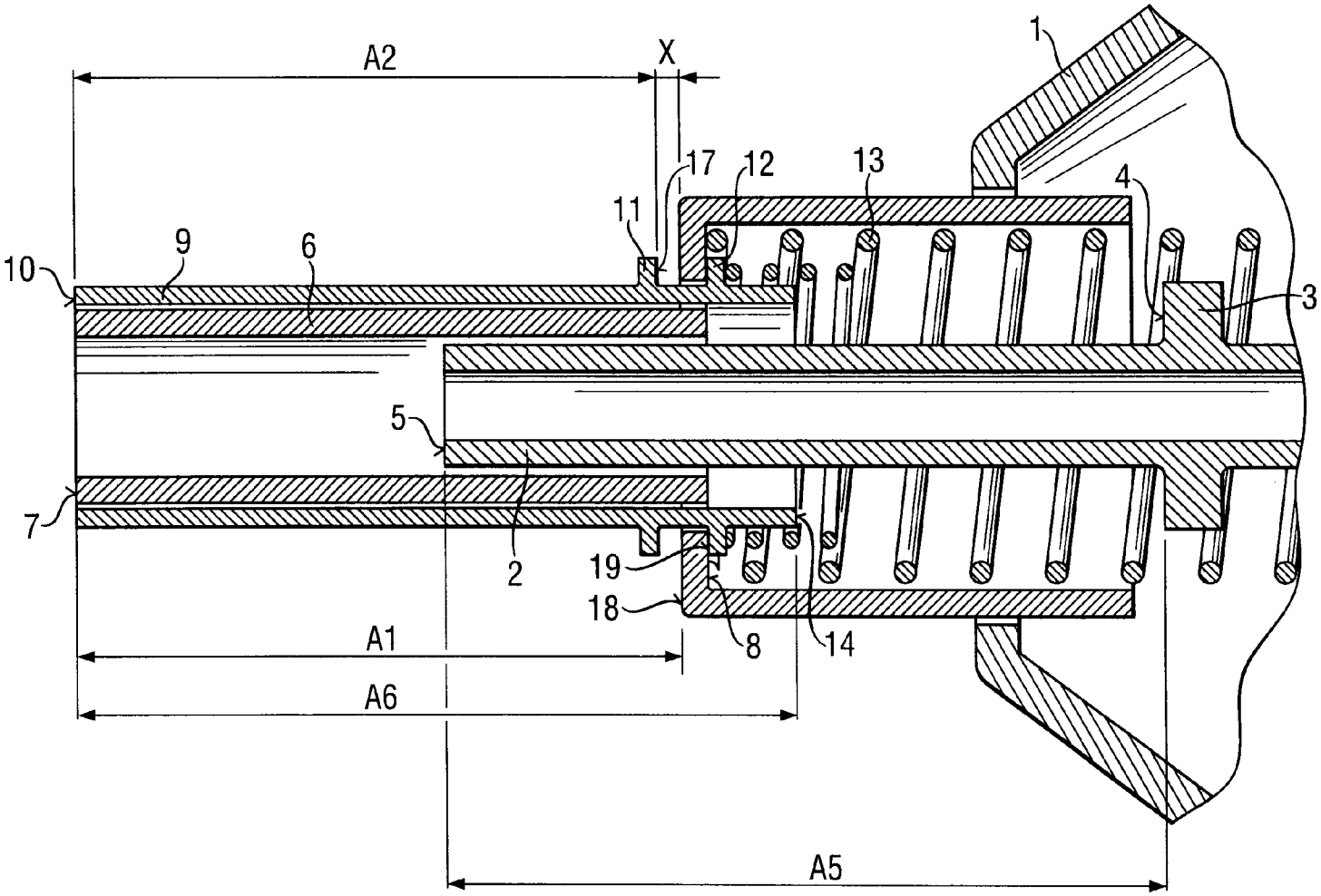
FIG. 1 a partial cross-sectional view of a setting tool according to the present invention in its initial position.
Figure 2:
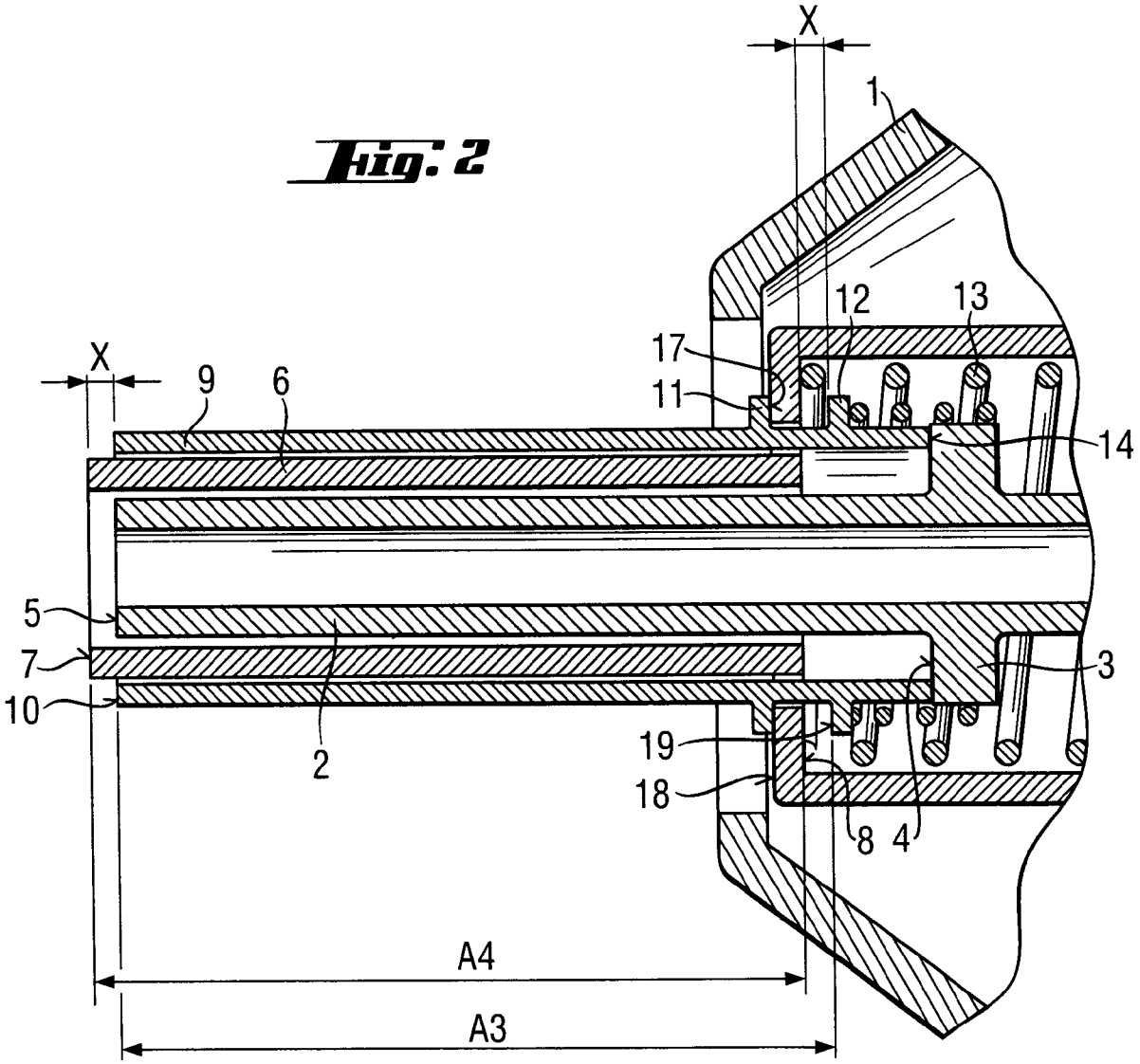
FIG. 2 a partial cross-sectional view of the setting tool shown in FIG. 1 with a manually pushed back, safety sleeve.
Figure 3:
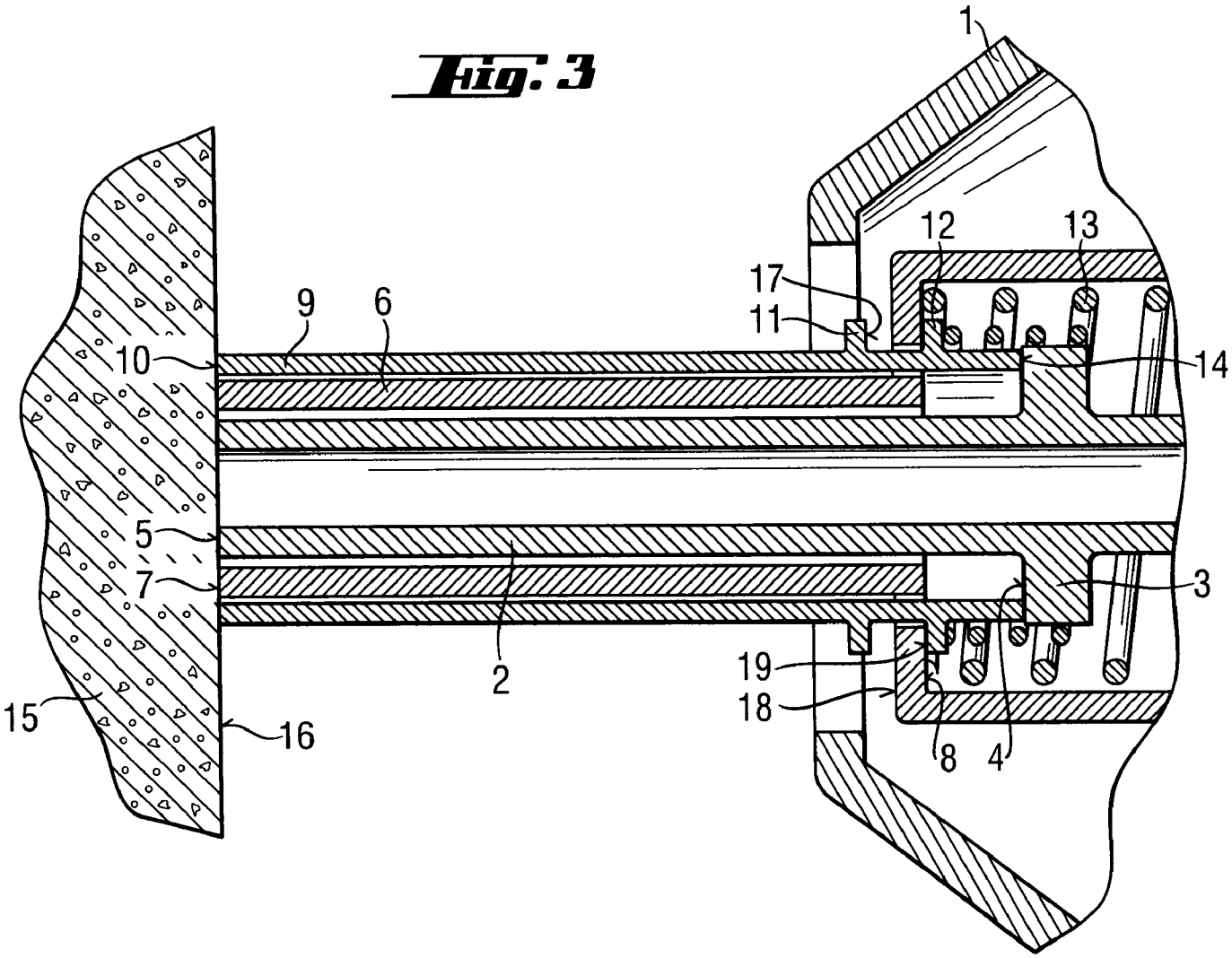
FIG. 3 a partial cross-sectional view of the setting tool shown in FIG. 1 in a pressed-on condition.

A setting tool according to the present invention, which is shown in FIGS. 1–3, has a housing 1 shown only partially, and bolt guide 2 fixedly axially secured in the housing 1. The bolt guide 2 is formed as a tubular member and has a flange-like shoulder 3. The shoulder 3 forms a stop surface 4 facing in the setting direction, i.e., in a direction in which a to-be-set element is displaceable. The stop surface 4 is spaced from a setting direction side, end surface 5 of the bolt guide 2 by a distance A5.

The bolt guide 2 is surrounded by a tubular press-on feeler 6 which widens in a step-shaped manner in a direction opposite the setting direction and, thus, is formed with two sections having different diameters. The first, setting direction side, section of the feeler 6 has an inner diameter that substantially corresponds to the outer diameter of the bolt guide without the shoulder 3. The second section, which adjoins the first section at its side facing in the direction opposite the setting direction, has a larger inner diameter. The step-shaped second section forms a countersurface 18 facing in the setting direction and a support surface 8 facing in the direction opposite the setting direction. the support surface 8 supports a spring 13 projecting from the tool housing 1. In order to achieve a good guidance of the spring 13 in the second section of the feeler 6, the outer diameter of the spring 13 is so selected that it corresponds substantially to the inner diameter of the second section. The inner diameter of the spring 13 is greater than the shoulder 3 of the bolt guide 2. The support surface 8 is spaced from the end surface of the press-on feeler 6 facing in the setting direction by a distance A4.

A safety sleeve 9 surrounds the first section of the press-on feeler 6. The length A6 of the safety sleeve 9, i.e., the distance between the facing in the setting direction, end surface 10 of the safety sleeve 9 and its free face, facing in the direction opposite the setting direction, end 14, is greater than the distance A1 between the end surface 7 of the press-on feeler 6 facing in the setting direction and the counter-surface 18 of the press-on feeler 6. The safety sleeve 9 extends through the tubular press-on feeler 6 in the transition region between the first and second sections of feeler 6. On the outer profile of the safety sleeve 9, there are provided two circumferential flange-shaped projections 11 and 12. The first, setting direction-side projection 11 is provided in the region first section of the press-on feeler 6. The second projection 12 is located within the second section of the press-on feeler 6.

The first projection 11 of the safety sleeve 9 has an entraining surface 17 facing in the direction opposite to the setting direction. The entraining surface 17 is spaced from the setting direction-side, end surface 10 of the safety sleeve 9 by a distance A2. The second projection 12 of the safety sleeve 9 has a facing in the setting direction, bearing surface 19 that cooperates with the support surface 8 of the press-on feeler 6. The bearing surface 19 is spaced from the setting direction-side, end surface 10 of the safety sleeve 9 by a distance A3.

As it has already mentioned previously, FIG. 1 shows the initial position of the setting tool, i.e., a position before the setting tool is pressed against a surface 16 of a structural component (see FIG. 3) with its setting direction region, i.e., with the end surface 7 of the press-on filler 6 and the end surface 10 of the safety sleeve 9. The end surfaces 7 and 10 of the press-on feeler 6 and the safety sleeve 9, respectively, lie in the same plane and project beyond the setting direction-side, end surface 5 of the bolt guide 2. In this position of the setting tool, the bearing surface 19 of the projection 12 of the safety sleeve 9 abuts the support surface 8 of the press-on feeler 6. A spring (not shown in detail) is provided for biasing the bearing surface 19 against the support surface 8, i.e., into a position in which both end surfaces 7 and 10 of the feeler 6 and the safety sleeve 9, respectively, lie in the same plane. The spring is supported against a surface of the safety sleeve projection 12 which faces in the direction opposite to the setting direction. The entraining surface 17 of the safety sleeve 9 is spaced from the counter-surface 18 of the press-on feeler 6 by a distance X which corresponds to a difference between the distances A1 and A2.

FIG. 2, as it also has been mentioned previously, shows the position of the setting tool with the safety sleeve 9 being manually pushed back, with its end surface 14 facing in the direction opposite to the setting direction, abutting the stop surface 4 of the shoulder 3 of the bolt guide 2. In the retracted position of the safety sleeve 9, the entraining surface 17 of the projection 11 of the safety sleeve 9 abut the setting direction-side, counter-surface 18 of the press-on filler 6. In this position of the safety sleeve 9, the spring 13 is preloaded, and the setting direction-side end surfaces 5 and 10 of the bolt guide 2 and the safety sleeve 9 lie in a plane beyond which the setting direction, end region of the press-on feeler projects. The amount, by which the press-on feeler 6 extends beyond the bolt guide 2 and the safety sleeve 9, corresponds to the length difference X between the distances A1 and A2. The length difference X is selected to be very small so that the tool user could not grasp the outer profile of the feeler 6 and to push it somewhat more in the direction opposite to the setting direction. the displacement of the feeler 6 in the direction opposite the setting direction is necessary for actuation of a device (not shown) for feeding the propellant gases.

FIG. 3 shows a press-on position of the setting tool. The end surfaces 5, 7, 10 of the bolt guide 2, the press-on feeler 6, and the safety sleeve 9, respectively, all abut the surface 16 of the constructional component 15. In this position of the setting tool, the end surface 14 of the safety sleeve 9, which faces in a direction opposite the setting direction, abuts the stop surface 4 of the shoulder 3 of the bolt guide 2. The support surface 8 of the press-on feeler 6, which likewise faces in the direction opposite the setting direction, abuts the bearing surface 19, which faces in the setting direction, of the projection 12 of the safety sleeve 9.

Though the present invention was shown and described with references to the preferred embodiment, such is merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiment within the spirit and scope of the present invention as defined by the appended claims.

What is claimed is:

1. A setting tool, comprising a housing (1); a bolt guide (2) secured in the housing (1) against displacement in an axial direction and having a radial, flange-shaped shoulder (3) having a stop surface (4) facing in a setting direction; a press-on feeler (6); a spring (13) for biasing the press-on feeler (6) in the setting direction; and an axially displaceable safety sleeve (9) surrounding the press-on feeler (6), the safety sleeve (9) having an entraining surface (17) facing in a direction opposite the setting direction and cooperating with a facing in setting direction, counter-surface of the press-on feeler (6) in a position of the safety sleeve (9) in which a facing in a direction opposite the setting direction, free end surface (14) thereof engages the stop surface (4) of the bolt guide (2), wherein a first distance (A1) between the setting direction-side, end surface (7) of the press-on feeler (6) and the counter-surface (18) thereof is greater than a second distance (A2) between a setting direction-side, end surface (10) and the entraining surface (17) of the safety sleeve (9), and wherein a sixth distance (A6) between the free-end surface (14) of the safety sleeve (9) and a setting direction side, end surface (10) of the safety sleeve (9) corresponds at most to a fifth distance (A5) between the end surface (5) of the bolt guide (2) and the stop surface (4) thereof.

2. A setting tool according to claim 1, wherein a third distance (A3) between the setting direction-side, end surface (10) of the safety sleeve (9) and a facing in the setting direction, bearing surface (19) of the safety sleeve (9) corresponds at most to a fourth distance (A4) between the setting direction-side, end surface (7) of the press-on feeler (6) and a facing in a direction opposite the setting direction, support surface (8) thereof.

3. A setting tool according to claim 2, wherein the entraining surface (17) of the safety sleeve (9) is formed by a flange-shaped, first projection (11) provided on an outer profile of the safety sleeve (9).

4. A setting tool according to claim 3, wherein the bearing surface (19) of the safety sleeve (9) is formed by a flange-shaped second projection (12) provided on the outer profile of the safety sleeve (9) and spaced from the first projection (11) in the direction opposite the setting direction.

5. A setting tool according to claim 4, wherein a length distance (X) between the first (A1) and second (A2) distances and between the third (A3) and fourth (A4) distances corresponds to 0.1–0.5 of an outer diameter of the safety sleeve (9) without the first and second projections (11, 12).

6. A setting tool according to claim 1, wherein the counter-surface (18) of the press-on feeler (6) is formed by a facing in the setting direction, surface of a step-shaped second section of the press-on feeler (6).

7. A setting tool according to claim 6, wherein a support surface (8) of the press-on feeler (6) is formed by a facing in the direction opposite the setting direction, surface of the step-shaped second section of the press-on feeler (6).

* * * * *